US012274289B2

(12) United States Patent
Capo et al.

(10) Patent No.: US 12,274,289 B2
(45) Date of Patent: Apr. 15, 2025

(54) CASTING APPARATUS AND METHOD FOR THE PRODUCTION OF A CAST SHEET OF A MATERIAL CONTAINING ALKALOIDS

(71) Applicant: PHILIP MORRIS PRODUCTS S.A., Neuchatel (CH)

(72) Inventors: Silvia Capo, Capaccio-Paestum (IT); Chiara Fasciani, Avekzzano (IT); Rui Nuno Batista, Morges (CH)

(73) Assignee: Philip Morris Products S.A., Neuchatel (CH)

( * ) Notice: Subject to any disclaimer, the term of this patent is extended or adjusted under 35 U.S.C. 154(b) by 850 days.

(21) Appl. No.: 17/252,353

(22) PCT Filed: Jun. 28, 2019

(86) PCT No.: PCT/EP2019/067454

§ 371 (c)(1),
(2) Date: Dec. 15, 2020

(87) PCT Pub. No.: WO2020/002663

PCT Pub. Date: Jan. 2, 2020

(65) Prior Publication Data

US 2021/0267260 A1 Sep. 2, 2021

(30) Foreign Application Priority Data

Jun. 29, 2018 (EP) ..... 18181033

(51) Int. Cl.

| | |
|---|---|
| ***A24B 3/14*** | (2006.01) |
| ***A24B 15/14*** | (2006.01) |
| ***A24C 5/01*** | (2020.01) |

(52) U.S. Cl.

CPC ..... *A24B 3/14* (2013.01); *A24C 5/01* (2020.01); *A24B 15/14* (2013.01)

(58) Field of Classification Search

CPC ..... A24B 3/14; A24C 5/01

See application file for complete search history.

(56) References Cited

U.S. PATENT DOCUMENTS

| | | | |
|---|---|---|---|
| 4,325,391 | A | 4/1982 | Schmidt |
| 4,790,242 | A | 12/1988 | Driessen |

(Continued)

FOREIGN PATENT DOCUMENTS

| | | |
|---|---|---|
| JP | S39-8155 | 5/1939 |
| JP | S50-58306 | 5/1975 |

(Continued)

OTHER PUBLICATIONS

Office Action issued in Japan for Application No. 2020-570418 dated May 29, 2023 (5 pages). English translation included.

(Continued)

*Primary Examiner* — Christopher M Rodd
*Assistant Examiner* — Jennifer A Kessie
(74) *Attorney, Agent, or Firm* — Mueting Raasch Group

(57) ABSTRACT

The invention relates to a casting apparatus (100) to cast a sheet of a material containing alkaloids, the casting apparatus including: •a casting box (10) apt to contain a slurry (18) to be cast to form the sheet; •a slurry supply element (5) defining a feeding channel (15) apt to introduce the slurry into the casting box in a supply direction; •path diverting fins (19, 20) positioned within the feeding channel, the path diverting fins being apt to come into contact with the slurry inside the feeding channel; •a movable support (2); and •a casting blade (1) apt to cast the slurry contained in the casting box onto the movable support so as to form the cast sheet. The invention relates also to a method to cast a sheet of a material containing alkaloids.

12 Claims, 3 Drawing Sheets

(56) References Cited

U.S. PATENT DOCUMENTS

| | | | | |
|---|---|---|---|---|
| 5,697,385 | A | 12/1997 | Seymour | |
| 10,060,270 | B2 | 8/2018 | Lee | |
| 10,463,068 | B2 | 11/2019 | Soo | |
| 2012/0180529 | A1* | 7/2012 | Singer | B01F 27/0724 366/302 |

FOREIGN PATENT DOCUMENTS

| | | |
|---|---|---|
| JP | 2018-500017 | 1/2018 |
| JP | 2018-512536 | 5/2018 |
| WO | WO 2016/050471 | 4/2016 |
| WO | WO 2017/041920 | 3/2017 |

OTHER PUBLICATIONS

Search Report and Written Opinion for PCT/EP2019/067454 dated Oct. 28, 2019 (11 pages).

* cited by examiner

CASTING APPARATUS AND METHOD FOR THE PRODUCTION OF A CAST SHEET OF A MATERIAL CONTAINING ALKALOIDS

This application is a U.S. National Stage Application of International Application No. PCT/EP2019/067454 filed Jun. 28, 2019, which was published in English on Jan. 2, 2020 as International Publication No. WO 2020/002663 A1. International Application No. PCT/EP2019/067454 claims priority to European Application No. 18181033.4 filed Jun. 29, 2018.

This invention relates to a casting apparatus and method for producing a cast web of a material containing alkaloids.

In particular, the material containing alkaloids is homogenized tobacco material, preferably used in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf (TCL is the acronym for tobacco cast leaf). The process to form homogenized tobacco material sheets commonly comprises a step in which tobacco dust and a binder, are mixed to form a tobacco slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. A process for making such homogenized tobacco is for example disclosed in European Patent EP 0565360.

In a "heat-not-burn" aerosol-generating article, an aerosol-forming substrate is heated to a relatively low temperature, in order to form an aerosol but prevent combustion of the tobacco material. Further, the tobacco present in the homogenized tobacco material is typically the only tobacco, or includes the majority of the tobacco, present in the homogenized tobacco material of such a "heat-not burn" aerosol-generating article. This means that the aerosol composition that is generated by such a "heat-not burn" aerosol-generating article is substantially only based on the homogenized tobacco material. Therefore, it is important to have good control over the composition of the homogenized tobacco material, for the control for example, of the taste of the aerosol.

Due to variations in the physical properties of the slurry, for example, consistency, viscosity, fibre size, particle size, moisture or the age of the slurry, standard casting methods and apparatus may result in unintended variations in the application of the slurry onto a support during the casting of web of homogenized tobacco. A non-optimal casting method and apparatus may lead to inhomogeneity and defects of the cast web of homogenized tobacco.

Inhomogeneity in the homogenized tobacco web may lead to difficulties in subsequent handling of the homogenized tobacco web in the production of the aerosol-generating article. For example, inhomogeneity may lead to tearing or even rupture of the web during manufacture or further processing of the web. This in turn could, for example, result in machine stops. Additionally, an inhomogeneous tobacco web may create unintended difference in the aerosol delivery between aerosol generating articles that are produced from the same homogenized tobacco web.

There is a need for a casting apparatus and method for the production of a cast web of a material containing alkaloids that is adapted to overcome, or at least decrease, the above-mentioned issue.

The invention relates to a casting apparatus to cast a sheet of a material containing alkaloids, the casting apparatus including: a casting box apt to contain a slurry to be cast to form the sheet; a slurry supply element defining a feeding channel apt to introduce the slurry into the casting box in a supply direction; path diverting fins positioned within the feeding channel, the path diverting fins being apt to come into contact with the slurry inside the feeding channel; a movable support; and a casting element apt to cast the slurry contained in the casting box onto the movable support so as to form the cast sheet.

The proposed casting apparatus aims to achieve a uniform slurry deposition on the movable support. The presence of the fins in the flow path of the slurry increases the mixing of the slurry when it enters the casting box. The flow of slurry may be directed to the casting box via different pipes or distributors and the fins may turn the different flows, one per pipe or distributor, into a single homogenized flow which enters the casting box.

Preferably, the casting element is a casting blade. Homogeneity of the slurry is of particular importance when the slurry, in order to be casted, has to flow through a gap formed between the blade and the movable support.

As used herein, the terms "sheet" denotes a laminar element having a width and length substantially greater than the thickness thereof. The width of a sheet is preferably greater than about 10 millimeters, more preferably greater than about 20 millimeters or about 30 millimeters. Even more preferably, the width of the sheet is comprised between about 100 millimeters and about 300 millimeters. A continuous "sheet" is herein called "web".

As used herein, the term "casting blade" denotes a longitudinally shaped element that may have an essentially constant cross-section along major parts of its lengthwise extension. It shows at least one edge that is intended to come into contact with a pasty, viscous or liquid-like substance to be influenced by said edge, such as a slurry. Said edge may have a sharp and knife-like shape. Alternatively, it may have a rectangular or a rounded shape.

As used herein, the term "movable support" denotes any means comprising a surface that can be moved in at least one longitudinal direction. The movable support may form a closed loop so to provide an uninterrupted transporting ability in one direction. However, the movable support may be moved in back and forth moving way as well. The movable support may include a conveyor belt. The movable support may be essentially flat and may show a structured or an unstructured surface. The movable support may show no openings in its surface or may show only orifices of such a size that they are impenetrable for the slurry deposited on it. The movable support may comprise a sheet-like movable and a bendable band. The band may be made of a metallic material, including but not limited to steel, copper, iron alloys and copper alloys, or a rubber material. The band may be made of a temperature-resistant material so that it can be heated to speed up the drying process of the slurry.

As used herein, the term "slurry" denotes a liquid-like, viscous or pasty material that may comprise an emulsion of different liquid-like, viscous or pasty material and that may contain a certain amount of solid-state particles, provided that the slurry still shows a liquid-like, viscous or pasty behaviour.

A "material containing alkaloids" is a material which contains one or more alkaloids. The alkaloids may comprise nicotine. The nicotine may be found, for example, in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

As used herein, the term "homogenised tobacco material" denotes material formed by agglomerating particulate tobacco, which contains the alkaloid nicotine. The material containing alkaloids can thus be a homogenized tobacco material.

The most commonly used forms of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making.

The homogenized tobacco sheet material can be also referred to as a reconstituted sheet material and formed using particulate tobacco (for example, reconstituted tobacco) or a tobacco particulate blend, a humectant and an aqueous solvent to form the tobacco composition. This tobacco composition may be then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The homogenized tobacco sheet generally includes, in addition to the tobacco, a binder and an aerosol-former, such as guar and glycerin.

As used herein, the term "aerosol forming material" denotes a material that is capable of releasing volatile compounds upon heating to generate an aerosol. Tobacco, together with other compounds, may be classified as an aerosol forming material, particularly a sheet of homogenized tobacco comprising an aerosol former. An aerosol forming substrate may comprise or consist of an aerosol forming material. The homogenized tobacco sheet can be used as an aerosol forming material.

The slurry may comprise a number of different components or ingredients. These components may influence the properties of the cast web of material containing alkaloids. A first ingredient is a material containing alkaloids, for example in powder form. This material can be for example a tobacco powder blend, which preferably contains the majority of the tobacco present in the slurry. The tobacco powder blend is the source of the majority of tobacco in the homogenized tobacco material and thus gives the flavor to the final product, for example to an aerosol produced heating the homogenized tobacco material. A cellulose pulp containing cellulose fibers is preferably added to the slurry in order to increase the tensile strength of the alkaloids material web, acting as a strengthening agent. A binder may be added. An aerosol-former may be added. Binder and aerosol-former are preferably added in order to enhance the tensile properties of the homogenized sheet and promote the formation of aerosol. Further, in order to reach a certain viscosity and moisture optimal for casting the web of material containing alkaloids, water may be added to the slurry.

The quantity of binder added to the slurry may be comprised between about 1 percent and about 5 percent in dry weight of the slurry. More preferably, it is comprised between about 2 percent and about 4 percent. The binder used in the slurry may be any of the gums or pectins described herein. The binder may ensure that the tobacco powder remains substantially dispersed throughout the homogenized tobacco web. Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

The introduction of cellulose fibres in the slurry typically increases the tensile strength of the tobacco material web, acting as a strengthening agent. Therefore, adding cellulose fibres may increase the resilience of the homogenized tobacco material web. Cellulose fibres for including in a slurry for homogenized tobacco material are known in the art and include, but are not limited to: soft-wood fibres, hard wood fibres, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof. Cellulose fibres may include tobacco stem materials, stalks or other tobacco plant material. Preferably, cellulose fibres such as wood fibres comprise a low lignin content. Alternatively fibres, such as vegetable fibres, may be used either with the above fibres or in the alternative, including hemp and bamboo. The length of cellulose fibres is advantageously between about 0.2 millimetres and about 4 millimetres. Preferably, the mean length per weight of the cellulose fibres is between about 1 millimetre and about 3 millimetres. Further, preferably, the amount of the cellulose fibres is comprised between about 1 percent and about 7 percent in dry weight basis of the total weight of the slurry (or homogenized tobacco sheet).

Suitable aerosol-formers for inclusion in slurry for homogenised tobacco material are known in the art and include, but are not limited to: monohydric alcohols like menthol, polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Examples of preferred aerosol-formers are glycerine and propylene glycol.

The slurry may have an aerosol-former content of greater than about 5 percent on a dry weight basis. The slurry may have an aerosol former content of between about 5 percent and about 30 percent by weight on a dry weight basis. More preferably, the aerosol-former is comprised between about 10 percent to about 25 percent of dry weight of the slurry. More preferably, the aerosol-former is comprised between about 15 percent to about 25 percent of dry weight of the slurry.

The binder and the cellulose fibers are preferably included in a weight ratio comprised between about 1:7 and about 5:1. More preferably, the binder and the cellulose fibers are included in a weight ratio comprised between about 1:1 and about 3:1.

The binder and the aerosol-former are preferably included in a weight ratio comprised between about 1:30 and about 1:1. More preferably, the binder and the aerosol-former are included in a weight ratio comprised between about 1:20 and about 1:4.

Preferably, the alkaloid containing material is tobacco. The binder and the tobacco particles are preferably included in a weight ratio comprised between about 1:100 and about 1:10. More preferably, the binder and the tobacco particles are included in a weight ratio comprised between about 1:50 and about 1:15, even more preferably between about 1:30 and 1:20.

The aerosol-former and the tobacco particles are preferably included in a weight ratio comprised between about 1:20 and about 1:1. More preferably, the aerosol-former and the tobacco particles are included in a weight ratio comprised between about 1:6 and about 1:2.

The aerosol former and the cellulose fibres are preferably included in a weight ratio comprised between about 1:1 and about 30:1. More preferably, the aerosol-former and the cellulose fibres are included in a weight ratio comprised between about 5:1 and about 15:1.

The cellulose fibres and the tobacco particles are preferably included in a weight ratio comprised between about 1:100 and about 1:10. More preferably, the cellulose fibres and the tobacco particles are preferably included in a weight ratio comprised between about 1:50 and about 1:20.

The apparatus of the invention includes a casting box to contain the slurry and a movable support where the slurry is cast using a casting element. The casting element is a casting blade. The movable support in its movement defines a casting direction.

The slurry may reach the casting box from a different location. The casting box therefore might not be the place where the slurry is formed. For example, the slurry may be created in a silo, from where it is transferred to the casting box via suitable piping. Preferably, the slurry is continuously supplied to the casting box while the slurry is cast onto the movable support to form a continuous web of material containing alkaloids. The silo and the casting box are thus preferably fluidly connected in order to allow the slurry flow from one to the other.

The casting-box is preferably box-shaped. Preferably, the casting box includes walls. More preferably, the walls in turn comprise sidewalls. The sidewalls may include a first and a second couple of opposite sidewalls, called first, second sidewalls in the first couple, and third and fourth sidewalls in the second couple. The sidewalls are preferably advantageously substantially vertical, or tilted with respect to a vertical plane. First and second sidewalls, and third and fourth sidewalls, are respectively one facing the other. Preferably, the walls of casting box also include a bottom wall. The bottom wall may include an aperture. Preferably, the whole bottom part of the casting box defines an aperture. The bottom wall, alternatively, can be completely closed.

The casting box may include a closed top wall or a lid, or the top wall can include an aperture. In case of a lid, it can be fixed, or movable. In the latter case, the lid might be slidable on the sidewalls of the casting box.

The walls of the casting box define an inner volume of the casting box itself, that is, the walls delimit an inner volume of the casting box. As mentioned, the casting box may include an aperture, for example in a bottom or top area, so that the box is not a completely closed container. The aperture is provided to cast the slurry. The inner volume of the casting box is thus in contact with the outside. Due to the presence of the aperture, the inner volume of the casting box is considered as the volume of a "theoretical" box where the area defined by the aperture is closed. The demarcation line between the inner volume of the box and the outside is therefore preferably made by considering the aperture closed by a wall. The aperture may be formed in more than one wall (for example, corner apertures, which are apertures formed at the corners of the box). Further, more than a single aperture might be present.

The casting blade is preferably arranged perpendicular to the casting direction. The web of material is formed by means of the casting blade that casts the slurry present in the casting box into the movable support. The casting box has preferably an opening in the bottom part and the movable support is positioned partly below the aperture. The slurry from the casting box comes into contact with the casting blade at the aperture. An edge of the casting blade forms a gap with the surface of the movable support and the slurry passes through the aperture defined by said gap. The thickness of the cast web of material may be determined by the distance, among others, between the edge of the casting blade that comes into contact with the slurry and the surface of the movable support, that is, by the dimension of the above defined gap.

In a different embodiment, the casting element includes a casting roller. In this embodiment, the casting box has preferably an aperture in the top part, and the movable support and the casting roller are both positioned facing the aperture and facing each other. Rotation of the roller, which is at least partly immerged in the slurry, causes a film of slurry to be casted onto the movable support. A gap is present between the casting roller and the movable support. The thickness of the cast web of material may be determined by the distance, among others, between the outer surface of the casting roller and the outer surface of the movable support, that is by the dimension of the above defined gap.

The slurry enters the casting box through a slurry supply element, which defines a supply channel. The supply channel is preferably as wide as the casting box, or slightly smaller, so that the slurry is deposited or enters substantially uniformly over the whole dimension of the casting box to minimize local increase of the slurry level. The width is considered as a dimension perpendicular to the casting direction. The supply channel defines an inlet for the slurry, corresponding to the outlet of the supply channel from which the slurry exits. This inlet is preferably oblong. The supply channel might be considered as a pipe having an oblong, such as oval or rectangular, cross section. To the supply channel, a single pipe or several pipes may converge transporting the slurry. The width of the cross section of the supply channel is preferably equal to the width of the inlet.

The feeding channel may be located above the casting box, for example facing the top portion of the casting box, which is preferably open or it includes an aperture. The feeding channel may face the slurry present in the casting box. The slurry falls from the feeding channel into the casting box in a "free fall" governed by gravity. The slurry may fall onto the already supplied slurry or onto a sidewall of the casting box, where it slides to reach the already supplied slurry.

The feeding channel may be connected to a sidewall of the casting box. In this case, the inlet for the slurry includes an aperture formed in a sidewall of the casting box. The feeding channel in this configuration is preferably substantially horizontal or slightly tilted from an horizontal plane.

The casting box includes a plurality of fins positioned in the feeding channel. The fins change the flow path of the slurry flowing into the feeding channel. The fins therefore divert the slurry from a substantially "linear" flow, that is a flow along a single substantially straight direction, to a more complex path because the slurry has to meander through the various surfaces defined by the fins. In this way, if in the feeding channel slurry from different pipes arrives, the fins allow a mixing and merging of the different incoming flows in a single more homogeneous one.

Without being bound by theory, the slurry has probably a shear-thinning behaviour, that is, there is an inverse proportion between its natural viscosity and the shear strain imposed. Thus, a good mixing of the slurry inside the casting box may be beneficial in the manufacturing process, in particular to control the thickness of the cast sheet. For this reason, preferably, fins which affect the flow of the slurry are inserted in the feeding channel. The fins, which may have a blade-like form, advantageously work as a mass distributor, as well as static mixing elements, as the slurry during its flow has to contour those fins, dispersing itself and creating non-linear flows. The slurry therefore has a "complex local movement" around the fins and at the same time an overall global movement flowing outside the channel into the casting box. A better mixed slurry flowing inside the casting box allow obtaining a more homogenized slurry present in the casting box.

The specific geometry, size, number and relative proximity between the fins enable to define their effects in the flow of the slurry. These parameters may be designed by computer simulations, given the outline of the feeding channel and the characteristics of the slurry.

The portion of the feeding channel containing the path diverting fins may be detached and removed from the slurry supply element.

The fins have a dimension which is much smaller than the other two, which is their thickness. The fins are preferably blade-like elements which are positioned in the feeding channel where they can interfere with the flow of the slurry. Each fin defines two substantially opposite main surfaces and a thin lateral surface connecting the two.

The fins may protrude from one of the walls of the feeding channels, for example they can be fixed on such a wall and extend from an internal surface of the wall in contact to the slurry. Preferably, the main surfaces of each fin are substantially perpendicular to the wall of the feeding channel. The fins may have a height equal to a dimension of the channel, so the fins may contact two opposite walls of the channel.

Preferably, the longest dimension, such as the height or width, of the fins is comprised between about 2 centimeters and 10 centimeters, more preferably it is comprised between about 4 centimeters and 8 centimeters.

In case many fins are present, all fins can be joined by a connecting element, such as a bar or a frame. The bar or frame may also connect the fins in groups. Each group might have a single connecting element different from the other groups. The connection is useful in order to remove all fins at the same time for cleaning or repairing purposes. Further, it is useful so that the position of all fins can be regulated at the same time.

The fins may be attached directly to the walls of the channels. The fins may be connected by the bar or frame and the bar or frame may be attached to the walls and the fins themselves may not be in contact with the walls of the channel.

Each of the fins may define an axis or direction. The fins on a top view form substantially a curve. This curve has a first and a second end. The direction defined by the fins, thus their axis, is given by a line joining the first and the second end.

Preferably, a sub-group of the path diverting fins includes fins having parallel axis one to the other. Preferably, the fins form groups where all fins "point" toward the same direction. For example, the path diverting fins may be divided in rows, and each row includes fins having parallel axes among each other. The rows of fins are positioned one downstream the other along the direction of flow of the slurry, for example, if a first and a second row of fins are present, the first row of fins is located downstream the second row in the direction of flow of the slurry.

The fins are preferably curved, that is, they define a concave portion or a convex portion. The fins may have more than a concavity. In a top view, the fins therefore may define a C shape, a S shape or similar. They can also be planar. The referred potential standard shapes of the cross-sections of the blades/fins are the ones commonly used for similar purposes, namely to create the required "deviation" or reorientation of the slurry in each specific spot, and then the combination of those. In terms of materials, fins are preferably realized in metal, more preferably in hard metallic alloys, such as stainless steel hard alloys. Alternatively or in addition, fins may include hardened surfaces, or other materials that have high resistance to the abrasion of the slurry, due to the high content of silica of the tobacco particles and its known abrasion effect in all types of materials, including metals. The "hard" material or coating is used because of the wear caused by the slurry and the nicotine content of the slurry, which is also chemically aggressive to materials in general.

"Longitudinal shading bands" which may appear in the cast sheet without the presence of fins may be not present when fins are located in the casting box. The different incoming flows of slurry are mixed together by the fins and a single more homogeneous flow is created.

Preferably, the slurry supply element includes a tapered portion. More preferably, the path diverting fins are positioned downstream the tapered portion in the supply direction. In this way, it is relatively easy to adjust the set-up for production, as well as to clean out the inside of the casting box.

Preferably, the feeding channel defines a channel width and the path diverting fins are distributed along the width of the channel. The width is a direction substantially perpendicular to the casting direction. Advantageously, the whole slurry is diverted by the fins so that a single homogeneous flow exits the feeding channel.

Preferably, the path diverting fins comprise a plurality of curved fins. Preferably, the fins are not flat, but they are curved. The main surfaces of the fins thus are curved surface. The curvature may be used to change the direction of the flow of the slurry in a plurality of different directions, depending on the surface orientation of the fin hit by the slurry.

Preferably, the plurality of curved fins is arranged in at least one row. More preferably, the curved fins of a same row have equally oriented concavity. More preferably, all fins in the same row have parallel axes. Preferably, many fins are present. More preferably, the fins are arranged along the whole width of the channel, which is generally similar to the width of the casting box, which is substantially equal to the width of the casting blade, so that all the slurry is affected by the fins presence. Preferably, the fins are disposed one adjacent to the other leaving a space therebetween so that the slurry can flow therethrough. The slurry therefore preferably flows through different channels, each channel being formed by two surfaces, one of a fin and one of the neighbour fin.

Preferably, each of the curved fins defines a concavity, the curved fins of a same row having equally oriented concavity. "Equally oriented concavity" means that all fins in a row have their concavity on the same side of their axis. The fins may have more than a single curvature. The fins of a row of fins, which preferably spans the whole width of the casting box, have preferably their curvatures pointing all in the same direction.

Preferably, the curved fins of two adjacent rows have their concavity oppositely oriented. The movement imparted to the flow by the fins is "as complex as possible" so that it deviates from linearity and a better mixing is obtained.

Preferably, the casting box includes sidewalls and the slurry supply element defines an inlet for the slurry, the inlet for the slurry being formed in one of the lateral walls. The slurry enters into the casting box via an aperture formed in one of the sidewalls.

Preferably, the slurry supply element defines an inlet for the slurry, the inlet for the slurry being positioned above or at a top portion of the casting box. The slurry is supplied from above the casting box and falls into the casting box by gravity.

The invention also relates to a method to cast a sheet of a material containing alkaloids, the method comprising: providing a casting box; providing a casting element connected to the casting box; providing a movable support facing the casting element; providing a slurry supply element defining a feeding channel; providing path diverting fins positioned within the feeding channel; introducing the slurry into the casting box along a supply direction trough the feeding channel; and casting the slurry on the movable support by means of the casting element.

Preferably, the casting element is a casting blade.

The advantages of the method have been already outlined when describing the apparatus and are not going to be repeated.

Preferably, the step of feeding the slurry inside the casting box comprises introducing the slurry in the casting box along a supply direction forming an angle with a horizontal plane comprised between about −45 degrees and about +45 degrees. A horizontal feeding of the slurry may provide for a better control of the flow of slurry inside the casting box because it is regulated by the applied pressure and not by gravity such in a "free-fall" case. Thanks to a feeding channel which is not vertical, the formation of air bubbles inside the casting box is reduced or minimized; furthermore the slurry contained in the casting box is not affected by the potential energy of the falling slurry and this may entail a more homogeneous (content and thickness) cast leaf due to a constant pressure condition within the casting box.

Preferably, the step of feeding the slurry inside the casting box comprises introducing the slurry in the casting box along a supply direction forming an angle with a vertical plane comprised between about −15 degrees and about +15 degrees.

Alternatively, the slurry may enter the casting box from above, that is, at the end of the feeding channel, there is a fall in the air of the slurry, which reaches the casting box positioned below. In this configuration, preferably the feeding channel is substantially vertical.

Preferably, the method includes the step of adjusting a position of the path diverting fins shifting the path diverting fins along the supply direction depending on parameters of the slurry or of the cast sheet. Preferably, the method includes adjusting an orientation of the path diverting fins with respect to the supply direction depending on parameters of the slurry or of the cast sheet. The position and the orientation of the fins can be regulated depending on the characteristics of the slurry and the desired characteristic of the cast sheet. The fins can be re-oriented and moved from and towards the inlet, shifting of a given amount.

Preferably, the cast sheet of a material containing alkaloids includes a homogenized tobacco sheet.

The invention may also relate to a casting apparatus to cast a sheet of a material, the casting apparatus including: a casting box apt to contain a slurry to be cast to form the sheet; a slurry supply element defining a feeding channel apt to introduce the slurry into the casting box in a supply direction; path diverting fins positioned within the feeding channel, the path diverting fins being apt to come into contact with the slurry inside the feeding channel; a movable support; and a casting element apt to cast the slurry contained in the casting box onto the movable support so as to form the cast sheet.

The invention may also relate to a method to cast a sheet of a material, the method comprising: providing a casting box; providing a casting element connected to the casting box; providing a movable support facing the casting element; providing a slurry supply element defining a feeding channel; providing path diverting fins positioned within the feeding channel; introducing the slurry into the casting box along a supply direction trough the feeding channel; and casting the slurry on the movable support by means of the casting element.

Further advantages of the invention will become apparent from the detailed description thereof with no-limiting reference to the appended drawings wherein.

Figure 1:
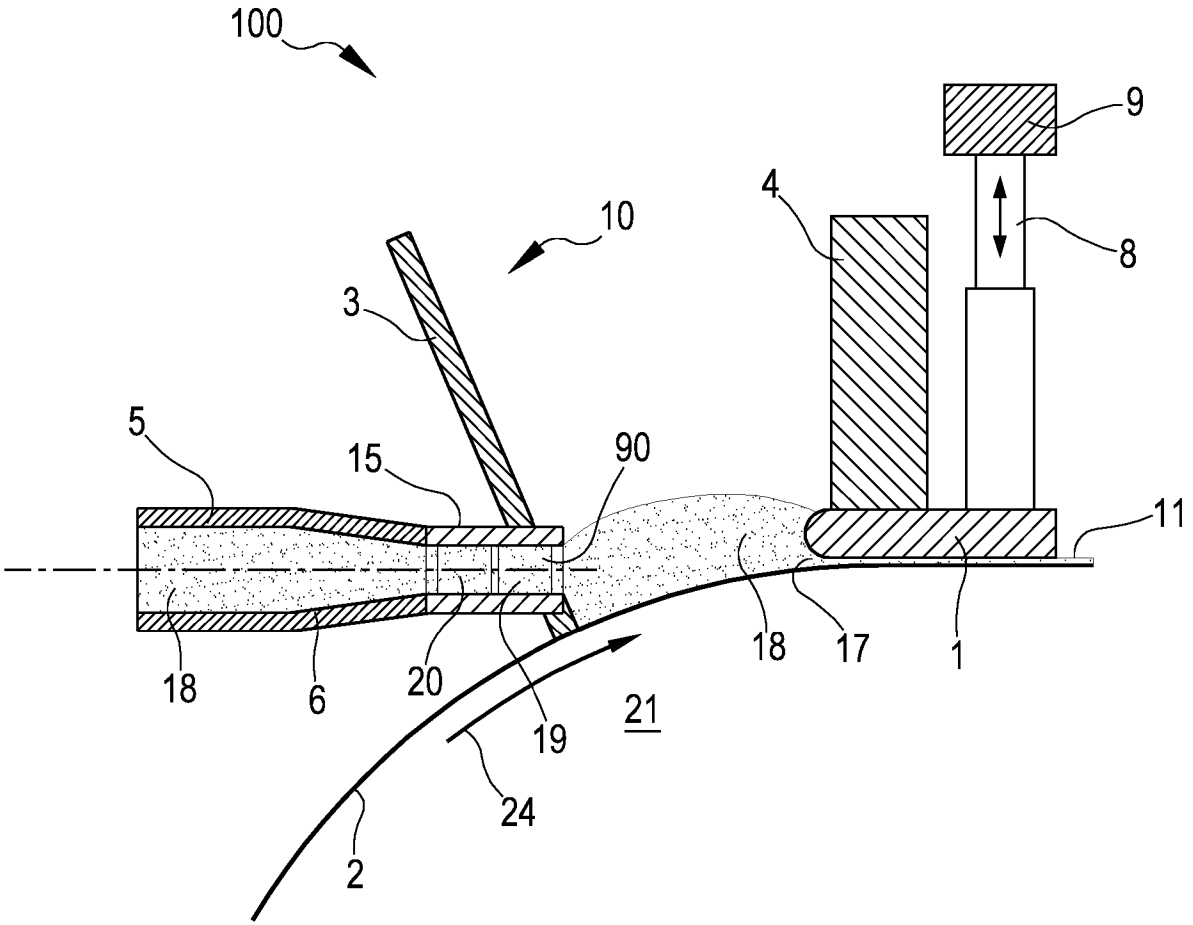
FIG. 1 is a schematic lateral section view of an apparatus for the production of a web of a material containing alkaloids.

With reference to FIG. 1, a first embodiment of a casting apparatus for the production of a cast web of a material containing alkaloids according to the present invention is represented and indicated with reference number 100. Only a portion of the casting apparatus 100 is shown in FIG. 1.

In particular, the casting apparatus 100 is adapted for the production of a cast web of a homogenized tobacco material 11.

The casting apparatus 100 comprises a casting box 10 containing slurry 18, a movable support 2, and a casting blade 1, wherein the casting blade 1 casts slurry 18 contained in the casting box 10 onto the movable support 2 so as to form the cast sheet of homogenized tobacco material 11. The movable support 2 defines a casting direction depicted by arrow 24 in FIG. 1.

Slurry 18 from buffer tanks (not shown in the drawings) is transferred into the casting box 10 usually by means of a pump (not shown in the drawings). Preferably, the pump comprises a control (not visible in the drawing) of flow rate to control the amount of slurry 18 introduced in the casting box 10. The pump is advantageously designed to ensure that slurry transfer times are kept to the minimum necessary. The pump is fluidly connected, for example by means of a slurry supply element 5, to the casting box 10 so as to feed the same with the slurry 18.

The casting box 10 comprises sidewalls including a first and a second opposite walls 3, 4. The casting blade 1 is associated to the casting box 10 at the second wall 4. The casting box 10 is generally defined by four side walls, i.e. the first and second opposite walls 3, 4 and a third and a fourth opposite walls (not shown in the figures), which connect the first and second opposite walls 3, 4.

The movable support 2 comprises for example a continuous stainless steel belt including a drum assembly. The drum assembly includes a main drum 21 located below the casting box 10 which moves the movable support 2. Preferably, the casting box 10 is mounted on top of the main drum 21.

The slurry is casted on the steel belt—at the drum 21—through the casting blade 1, which creates a continuous sheet of homogenized tobacco material. In order for the slurry to reach the casting blade and thus the movable support, the casting box 10 has an opening or aperture 17 in correspondence of its bottom and the opening 17 extends along a width of the casting box 10. The opening 17 is positioned over and in proximity of the drum 21.

The top portion of the casting box 10 in this embodiment is open.

The movement of the steel belt 2 forwards the slurry 18 towards the casting blade 1, for example towards the second wall 4. The casting blade 1 casts a part of the slurry 18 on the steel belt 2, while the remaining majority of the slurry 18 turns back and recirculates inside the casting box 10.

The casting blade 1 has a dominant dimension which is its longitudinal width. The casting blade 1 is for example substantially rectangular.

The casting blade 1 is attached to the casting box 10 preferably by means of an adjustable board 8 operated by an actuator 9 which allows a precise control of the position of the casting blade 1, in particular of its distance with respect to the movable support 2.

Between the casting blade 1 and the movable support 2 a gap is present, the dimensions of which determine—among others—the thickness of the cast web of homogenized tobacco material 11.

The slurry supply element 5 for the transfer of slurry 18 into the casting box, may have different positioning and shapes. In the embodiment of FIG. 1, the fluid supply element 5 includes a channel 15 which defines an inlet 90. The inlet 90 is substantially an aperture formed on the sidewall 3 of the casting box 10. Preferably, channel 15 is arranged substantially horizontally, so that at the inlet 90 the direction of the flow of slurry is substantially horizontal.

Further, casting box 10 includes a plurality of fins located in the channel 15. The fins are arranged in two substantially parallel first and second row, the second row being upstream of the first row in the direction of flow of the slurry. Any number of rows is possible. The fins of the first row are all indicated with 19 and the fins of the second row are all indicated with 20. The height of the fins is substantially similar to the height of channel 5.

Figure 3:
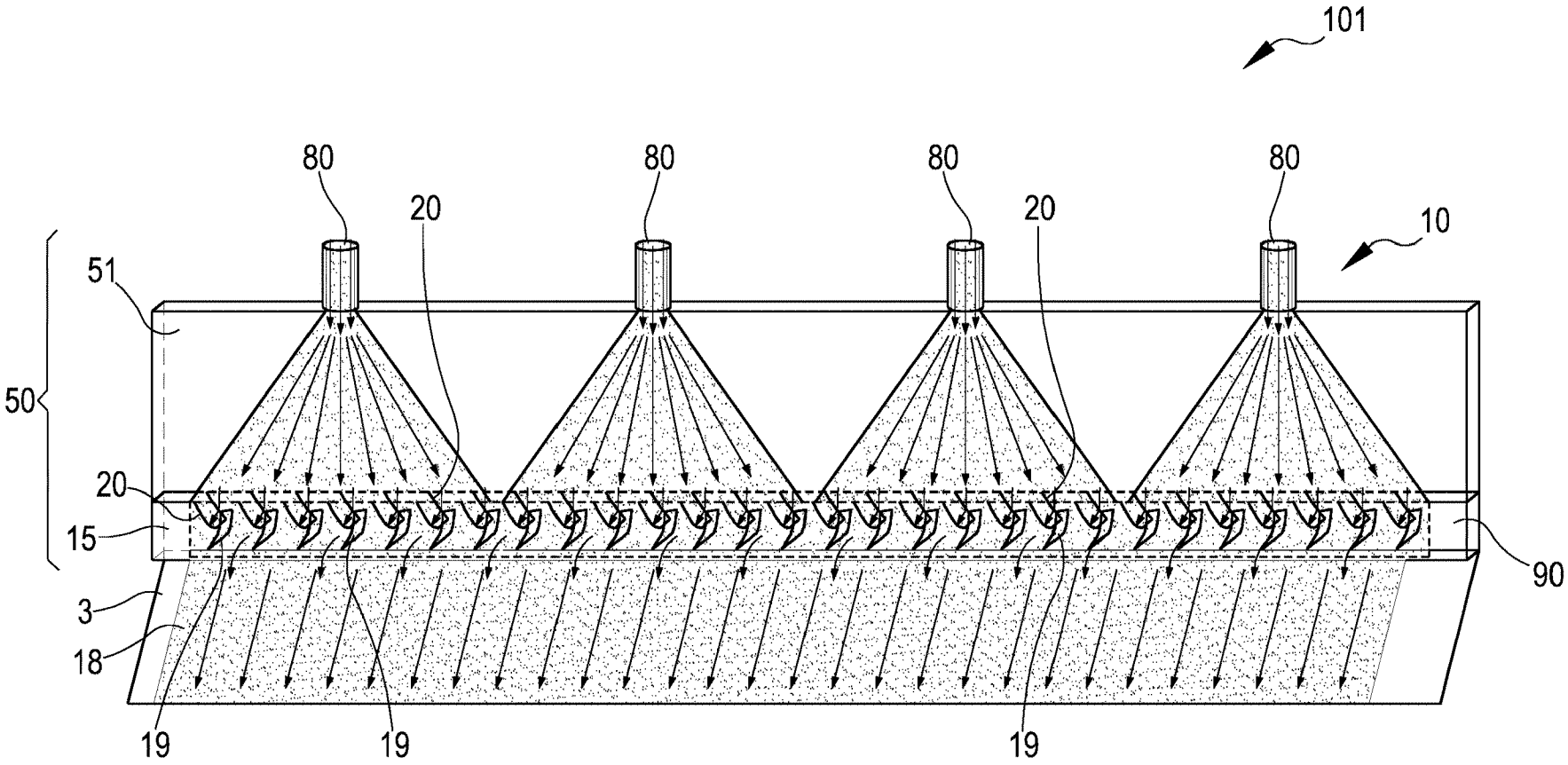
FIG. 3 is a schematic perspective view of a portion of the apparatus of FIG. 2.

Each fin 19, 20 of the first or second row on a top view defines a curved shape, the concavity of the fins having the same orientation in each row. FIG. 3 shows the first and second rows of fins clearly. Each fin 19, 20 has a C shape, where the concavity of the C is positioned substantially facing the main direction of flow of the slurry. Fins all have the same shape and all defines a major dimension. Each fin defines an axis, which is the continuation of a line joining a first and second end of the fin in a top view. In each row the fins are preferably parallel, that is, preferably they have parallel axes.

A first and a second adjusting elements, not visible in the drawings, may operate fins in order to change their position. First adjusting element may rotate the fins around their axis so that the orientation of each axis changes, while second adjusting element may change their exact position along the channel 15, closer or more remotely from inlet 90.

Slurry supply element 5, upstream the fins 19, 20 in the direction of flow of the slurry 18 in the channel 5, also preferably includes a tapered portion 6.

Figure 2:
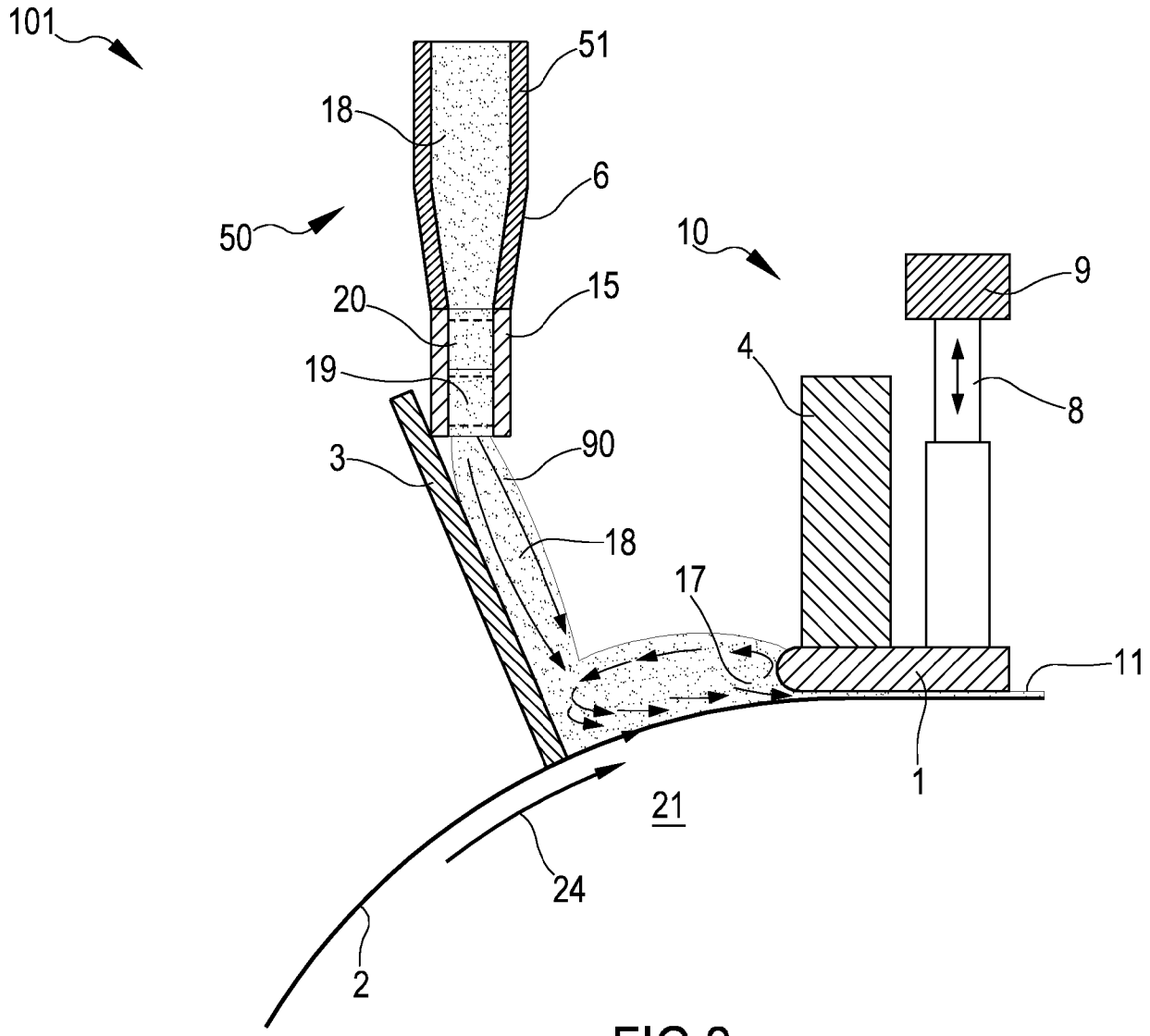
FIG. 2 is a schematic lateral section view of a further embodiment of an apparatus for the production of a web of a material containing alkaloids.

In FIGS. 2 and 3, a second embodiment of an apparatus 101 for the casting of a sheet 11 is visualized. The difference between this embodiment and the previous one lies in the slurry supply element 50.

The slurry supply element 50 comprises a plurality of pipes 80 and a distributor 51. The slurry is supplied from a single tubular pipeline (not visible) which is then split in the plurality of pipes 80. The flow of slurry from each pipe 80 opens up into a triangular shape inside distributor 51 in order to adapt and cover the total width of the casting box (see for example FIG. 3). Distributor 51 defines channel 15 including the fins 19, 20, having inlet 90. The slurry 18 is dropped in a continuous or discontinued way directly to the casting box from above, as visible in FIGS. 2 and 3. During the dropping from inlet 90 of the channel 15, the slurry drops may touch the sidewall 3 or not. In case it touches the sidewall 3, the slurry slides onto the same.

Fins 19, 20 are positioned inside the channel 15 in an identical manner as in the channel of the previous embodiment. Channel 15 of this embodiments is similar to channel 15 of the previous embodiment, just differently oriented, that is, it is substantially vertical instead of horizontal.

FIG. 3 shows the effect of the fins on the slurry incoming from the different piping 80. From a plurality of flows from different pipes 80 opened by distributor 51, a single flow is obtained thanks to the channel 15.

The functioning of the casting apparatus 100-101 is as follows. A slurry 18, formed preferably mixing and combining tobacco powder and other ingredients, is transferred from a buffer tank (not shown) using for example in line mixers (also not shown) to the casting apparatus 100-101 and in particular inside the casting box 10.

The slurry 18 is supplied for example by an horizontal channel 15 having the inlet 90, which is positioned at a rear or upstream side of casting box 10 (at the sidewall 3 of the casting box 10). The casting blade 1 is located at a front or downstream side of the casting box 10, near the sidewall 4. Alternatively, slurry is distributed from above, for example it enters the casting box via the open top portion of the same through a substantially vertical channel 15, and falls on the casting box 10 and/or slides along sidewall 3. In any case, the slurry has to pass through fins 19, 20 and homogenize.

Further, preferably the level of slurry in the casting box 10 is monitored. Preferably, also the moisture of the slurry inside the casting box 10 is monitored. Further, preferably, the density of the slurry 18 is monitored. The monitoring of the above mentioned parameters is performed by means of suitable sensors.

The thickness of the web of homogenized tobacco material and grammage controlled by nucleonic gauge immediately after casting are preferably continuously monitored and feedback-controlled using slurry measuring device.

The casting is performed by means of casting blade 1 forming a gap with the movable support 2, gap that can also be feedback controlled.

Further, the cast web undergoes a drying step by means of a drying apparatus (not visible in the drawings). The drying apparatus includes a plurality of individual drying zones. Each drying zone preferably includes steam heating on the bottom side of the support and heated air above the movable support 2 and preferably also adjustable exhaust air control. Within the drying apparatus, the homogenized tobacco web is dried to desired final moisture on the support 2.

The drying step includes preferably a uniform and gentle drying of the cast web in an endless, stainless steel belt dryer with individually controllable zones. During the drying, a monitoring step of the cast web temperature at each drying zone to ensure a gentle drying profile at each drying zone is preferably performed. The cast web is dried to desired final moisture on the steel belt 2 with steam pan heating from bottom and top air drying. Every drying zone is equipped with steam flow and pressure control and air temperature and air flow are fully adjustable to provide the desired drying profile and ensuring product residence time is respected.

The invention claimed is:

1. A casting apparatus to cast a sheet of a material containing alkaloids, the casting apparatus including:

a casting box apt to contain a slurry to be cast to form the sheet;

a slurry supply element defining a feeding channel apt to introduce the slurry into the casting box in a supply direction;

path diverting fins positioned within the feeding channel, the path diverting fins being apt to come into contact with the slurry inside the feeding channel, wherein the path diverting fins comprise a plurality of curved fins arranged in at least one row and wherein the curved fins of a same row have equally oriented concavity;

a movable support; and a casting blade apt to cast the slurry contained in the casting box onto the movable support so as to form the cast sheet.

2. The casting apparatus according to claim 1, wherein the slurry supply element includes a tapered portion.

3. The casting apparatus according to claim 2, wherein the path diverting fins are positioned downstream the tapered portion in the supply direction.

4. The casting apparatus according to claim 1, wherein the feeding channel defines a channel width and the path diverting fins are distributed along the width of the channel.

5. The casting apparatus according to claim 1, wherein the casting box includes sidewalls and the slurry supply element defines an inlet for the slurry, the inlet for the slurry being formed in one of the sidewalls.

6. The casting apparatus according to claim 1, wherein the slurry supply element defines an inlet for the slurry, the inlet for the slurry being positioned above or at a top portion of the casting box.

7. The casting apparatus according to claim 1, wherein the path diverting fins protrude from a wall of the feeding channel.

8. The casting apparatus according to claim 1, wherein the feeding channel comprises a wall, and wherein each of the path diverting fins comprises two main surfaces substantially perpendicular to the wall of the feeding channel.

9. The casting apparatus according to claim 1, wherein each of the path diverting fins comprises two main surfaces, wherein each of the two main surfaces are curved surfaces.

10. The casting apparatus according to claim 1, wherein the feeding channel defines a channel width, and wherein the path diverting fins are distributed along the channel width.

11. The casting apparatus according to claim 1, wherein the feeding channel defines a channel width substantially perpendicular to a casting direction defined by the movable support.

12. The casting apparatus according to claim 1, wherein the at least one row comprises a first row and a second row, and wherein the first row is located downstream of the second row in a direction of flow of the slurry.

* * * * *